US005438729A

United States Patent [19]

Powell

[11] Patent Number: 5,438,729

[45] Date of Patent: Aug. 8, 1995

[54] APPARATUS FOR CLEANING AIR DUCTS

[76] Inventor: Samuel O. Powell, 1115 Oak Hill Ave., Hagerstown, Md. 21740

[21] Appl. No.: 270,790

[22] Filed: Jul. 1, 1994

Related U.S. Application Data

[63] Continuation of Ser. No. 997,037, Dec. 28, 1992, abandoned.

[51] Int. Cl.[6] ..... F23J 3/02

[52] U.S. Cl. ..... 15/304; 15/345; 15/395; 15/406

[58] Field of Search ..... 15/304, 345, 346, 406, 15/393, 397, 404, 395

[56] References Cited

U.S. PATENT DOCUMENTS

| | | | |
|---|---|---|---|
| 3,805,317 | 4/1974 | Dickinson | 15/309.2 |
| 4,792,363 | 12/1988 | Franklin et al. | 15/395 |
| 4,869,080 | 9/1989 | Rovinsky et al. | 15/316.1 X |
| 4,968,333 | 11/1990 | Ellis et al. | 55/341.1 |
| 5,030,259 | 7/1991 | Bryant et al. | 55/302 |
| 5,069,691 | 12/1991 | Travis et al. | 55/126 |
| 5,107,568 | 4/1992 | Wade | 15/395 X |
| 5,109,567 | 5/1992 | Harrison | 15/395 X |
| 5,230,723 | 7/1993 | Travis et al. | 96/57 |
| 5,347,677 | 9/1994 | Prentice | 15/318 |

FOREIGN PATENT DOCUMENTS

| | | | |
|---|---|---|---|
| 109522 | 7/1982 | Japan | 15/406 |

*Primary Examiner*—Christopher K. Moore
*Attorney, Agent, or Firm*—Eugene F. Osborne, Sr.

[57] ABSTRACT

A cleaner for air distributing duct systems of buildings has a motor driven fan for developing a vacuum for the suction of contaminants and air from the interior of the ducts and for forcing the obtained contaminated air stream under positive pressure, relative to the ambient, through multiple stages of filtration. The filtered air is discharged locally within the building. Measurement and display of the vacuum and prefilter air pressures indicate to an attendant the status of the cleaner operation and the condition of the air filters. A viewing window allows observation of the contaminated air stream and the prefilter. A pneumatically driven agitator of multiple whips is introduced into the duct system to dislodge adhering contaminants from the interior walls of the ducts. The vertical stacking of modular subunits gives access for servicing each stage of filters and provides roll-about portability of the cleaner.

16 Claims, 10 Drawing Sheets

APPARATUS FOR CLEANING AIR DUCTS

This application is a continuation of application Ser. No. 07/997,037, filed Dec. 28, 1992, now abandoned.

BACKGROUND OF THE INVENTION

1. Field of the Invention

This invention relates to a method and apparatus for filtration cleaning of air ducts that are used in systems for interior heating, ventilating, and/or cooling of buildings.

2. Related Prior Art

Many modern residential, commercial, and industrial buildings have indoor air control systems for heating, ventilation, and cooling (HVAC) that recirculate air through extensive ducts which over time become laden with particulates of dust, fibers, pathogens, fungi, debris and the like creating a health hazard to the occupants. Periodic cleaning of the ducts is required for the health of the occupants and for efficient air system operation.

Portable motor vehicle mounted vacuum cleaning apparatus operates from the exterior of buildings and thus suffers in accessibility to the ducts in large and multiple story buildings. Cleaning efficiency suffers due to the long flexible hose or duct required to connect to the HVAC system ducts. Exhausted air is discharged into the atmosphere (U.S. Pat. 5,030,259). Vacuum cleaning apparatus for installation and operation from within buildings require assembly of modular units, sized for passage through doorways. In addition to the vacuum blower unit, one or more filter units including a high efficiency particulate air (HEPA) filter are required in that exhausted air of the apparatus is discharged into the interior environment of the building. Compressed air nozzles are introduced into the ducts as an effort to loosen contaminating materials from the inner surfaces of the ducts (U.S. Pat. Nos. 4,968,333 and 5,069,691). Effective vacuum cleaning suffers due to low capacity of the blowers and due to inefficient loosening of the contaminating materials adhered to the duct surfaces.

SUMMARY OF THE INVENTION

The present invention combines processes of vacuum cleaning of the ductwork with pressurized particulate filtering of the exhausted air stream. Vacuum cleaning is assisted by a multiple pneumatic whip agitator which is introduced within the interior of the ductwork to loosen deposited materials from the wall of the duct. Multiple stages of filtering allow the exhausted air to be discharged into the internal environment of the building. The apparatus is constructed of modules that are stacked vertically for passage through average doorways and for overall size reduction. The upper module is the fan unit which is adapted for optional sizes of vacuum hoses that are selected for effective cleaning through varying hose lengths. The exhausted air after filtration is discharged from the base module at floor level. The compressor for driving the pneumatic whip agitator is typically a separate unit.

An objective of this invention is to improve the efficiency of cleaning of air ducts, to loosen and evacuate adhering deposits and particulates from interior wall corners and crevices of the ducts.

Another objective of the invention is to achieve effective cleaning in ducts of variable cross section dimensions and lengths before reentry of the apparatus in the duct is required.

Another objective of the invention is to improve the filtering of the air stream being discharged into the interior of the building being cleaned.

Another objective of the invention is to reduce the size and weight of the portable units by means of vacuum cleaning and pressurized filtering in combination with pneumatic whip agitation within the interior of ducts to be cleaned.

Another objective of the invention is to reduce the floor space occupied by the fan-filtration unit.

Another objective of the invention is to stack fan and filter modules vertically for reducing occupied floor space and for easy access for servicing multiple staged filters.

Another objective of the invention is to provide visual means for observing the vacuum fan air stream at the input to the pressurized filtration modules.

Another objective of the invention is to provide instrumentation for simultaneous monitoring of the vacuum and pressure of the air within the fan-filtration unit for an indication of its operation and condition of the filters.

Another objective of the invention is to provide a separate operable air compressor for remotely driving the pneumatic whip agitator.

Another objective of tie invention is to power the fan-filtration unit from the available electrical supply of the building being cleaned.

Another objective of the invention is to provide interchangeable whip agitators as demanded by the air ducts to be cleaned.

BRIEF DESCRIPTION OF DRAWINGS

Other objectives and advantages may be observed from the description when viewed in conjunction with the accompanying drawings wherein.

DETAILED DESCRIPTION OF THE INVENTION

Figure 1:
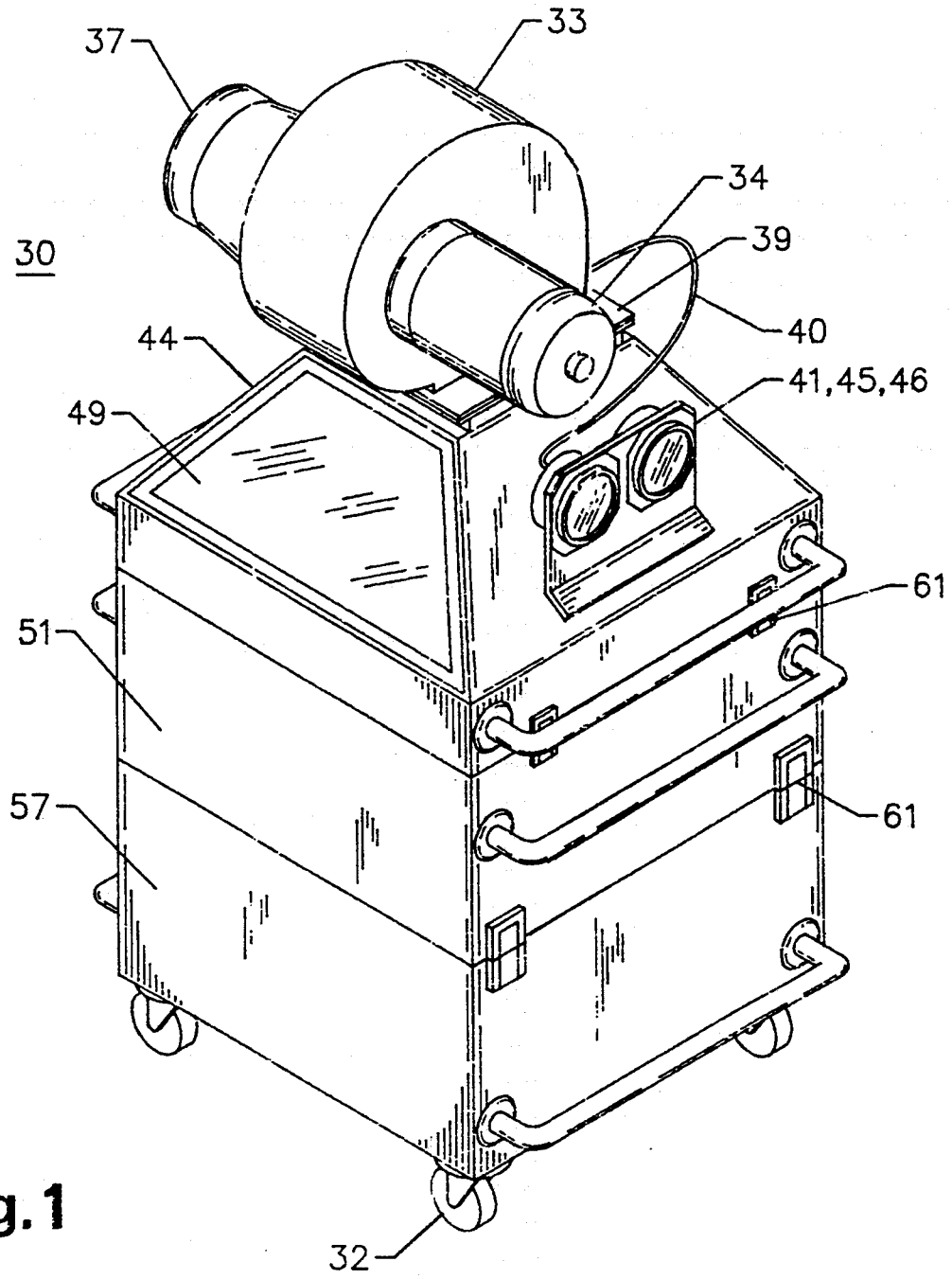
FIG. 1 is a perspective view of the assembled fan-filtration assembly.
Figure 2:
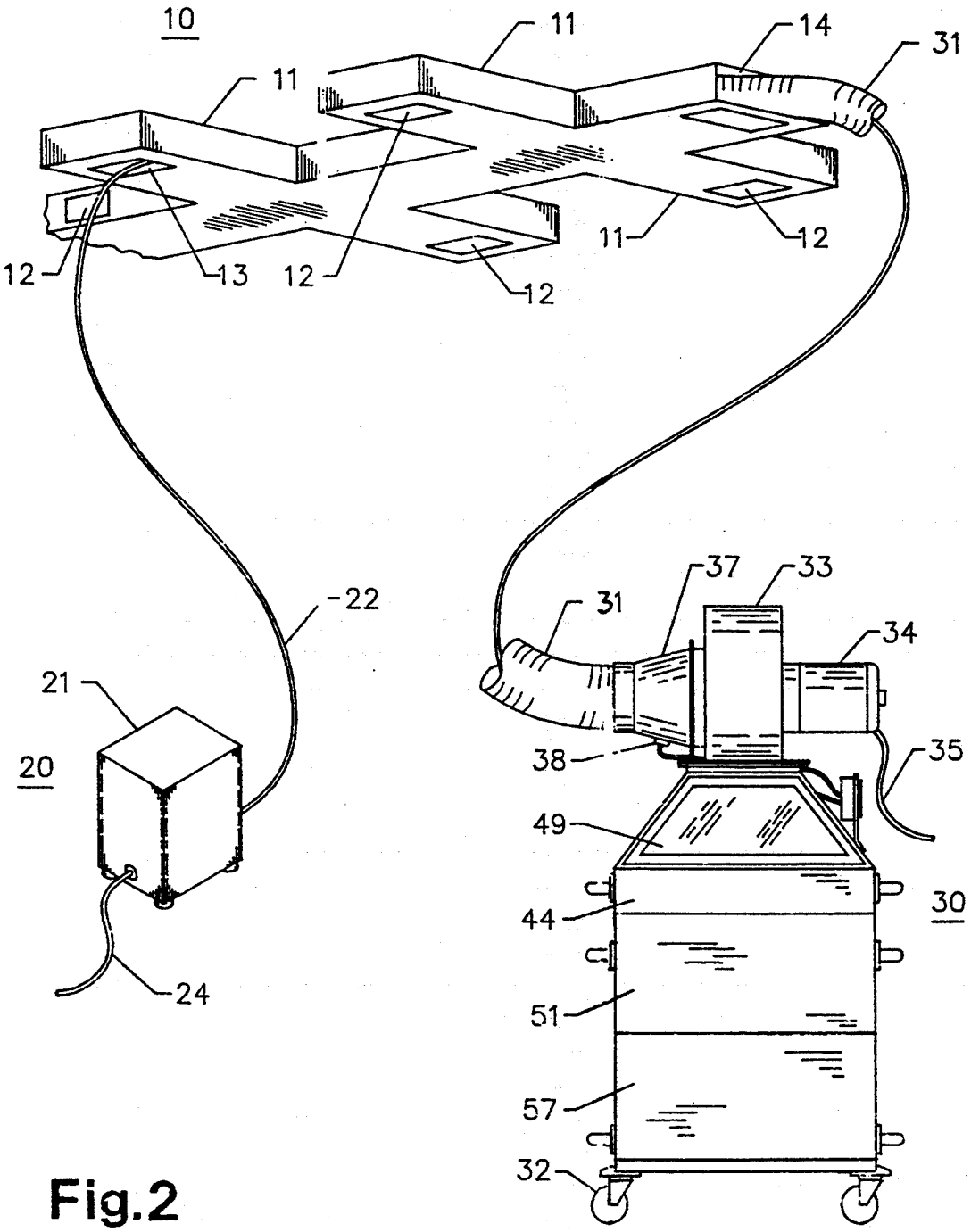
FIG. 2 is a diagrammatic illustration of the manner of use of the apparatus.
Figure 3:
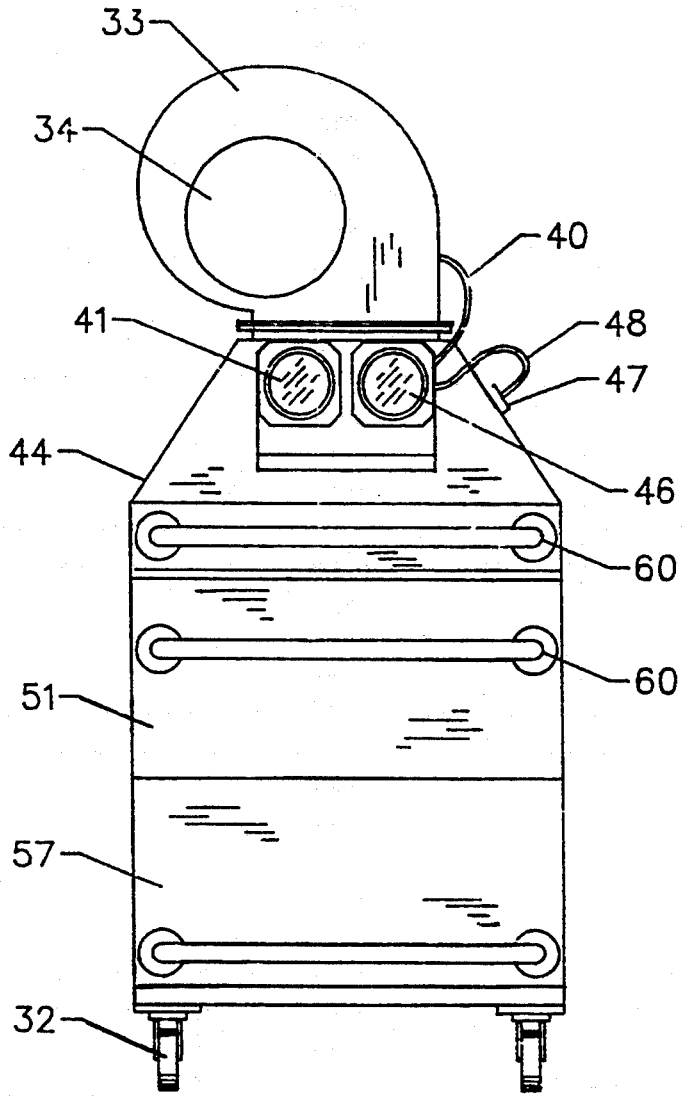
FIG. 3 is an elevation view of the operational side of the modular fan-filtration assembly showing vacuum and pressure gauges.

In reference to the drawings an improved cleaning fan and air filtration assembly is illustrated in FIGS. 1 and 3–11. An improved pneumatic whip agitator for dislodging foreign materials from the inside walls of the air ducts is illustrated in FIGS. 12–15. FIG. 2 illustrates the use of the combined apparatus in the cleaning of heating and air conditioning ducts from within the building where a portion of the air distribution ducts 10 is seen in relation to the pneumatic whip agitator 20 and the vacuum fan-filtration assembly 30.

The air duct system 10, typically, will have multiple branches 11 for flow to distributing registers 12 for heated or cooled air. For cleaning the duct system 10 all of the registers 12 are closed except for one open register 13 which is sequentially moved throughout the duct system 10 as the cleaning operation progresses. The compressed air hose 22 and the cleaning head assembly 23 of the pneumatic whip agitator 20 are inserted into the open register 13 and are advanced in the interior of the duct 10 to dislodge adhering matter from the interior walls. The compressed air hose 22 is of a flexible, commercial type with a spring steel tape 62 inserted inside its full length making the air hose suitable for forceful pushing or "snaking" through the duct 10. The air compressor 21 is of a commercial type powered electrically through cord 24 from the building electrical system, or powered by gasoline and generally operated outside the building.

An opening 14 is found or created into the duct system 10 into which the vacuum hose 31 is inserted and suitably sealed against vacuum leakage. The vacuum fan-filtration assembly 30 is adapted for vacuum hoses 31 of various lengths and diameters which may be interchanged according to the physical characteristics of the air duct system 10.

The preferred embodiment of the vacuum fan and air filtration assembly 30 is illustrated in FIGS. 1 and 3–6. The assembly 30 is portable with roll-about caster wheels 32 and contains four modular subassemblies vertically stacked in a form that is convenient for passage through doorways, etc. The uppermost module is the vacuum fan subassembly 33 which provides an electric motor 34 connected through power cord 35 to the building power system, a backward inclined blower or fan 36, a cone adaptor 37 containing a vacuum instrumentation port 38, and a flange 39 for assembly of the fan-filtration assembly 30. The instrumentation port 38 is connected by vacuum tubing 40 to the vacuum gauge 41. Interchangeable cone adaptors 37 are attachable by cone flanges 42 to the housing 43 of the fan subassembly 33.

Figure 4:
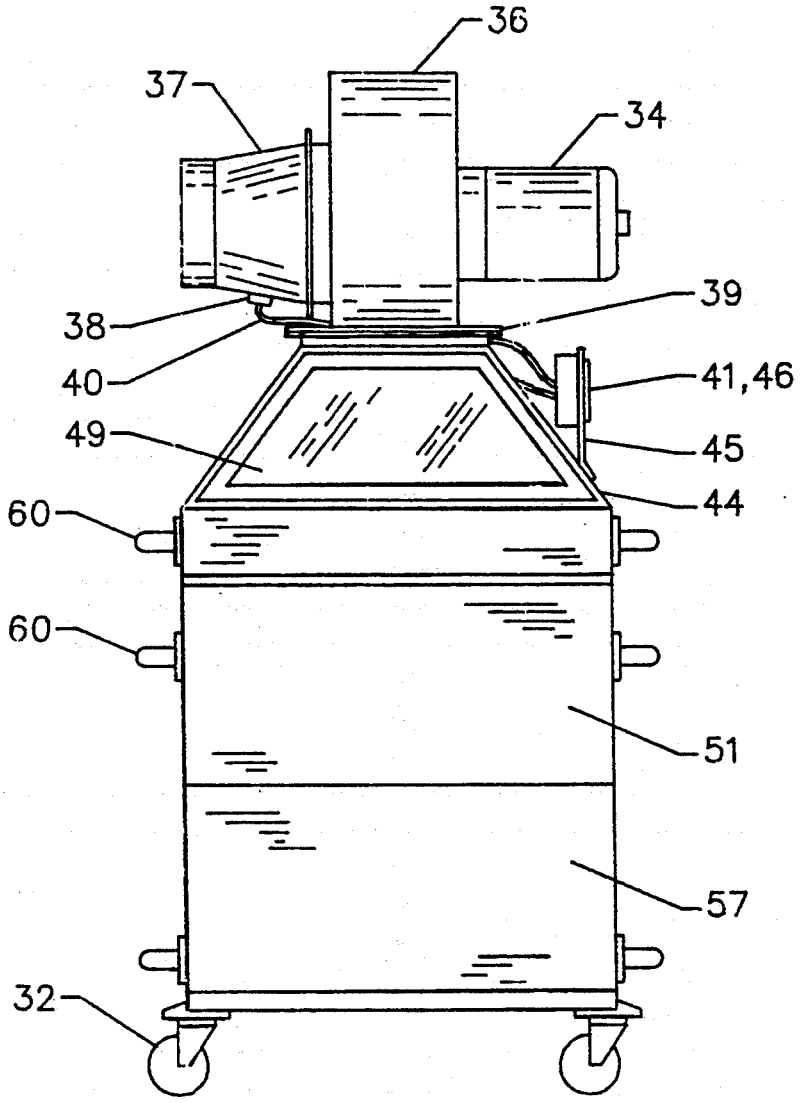
FIG. 4 is an elevation view of the left side of the modular fan-filtration assembly showing the observation window.
Figure 5:
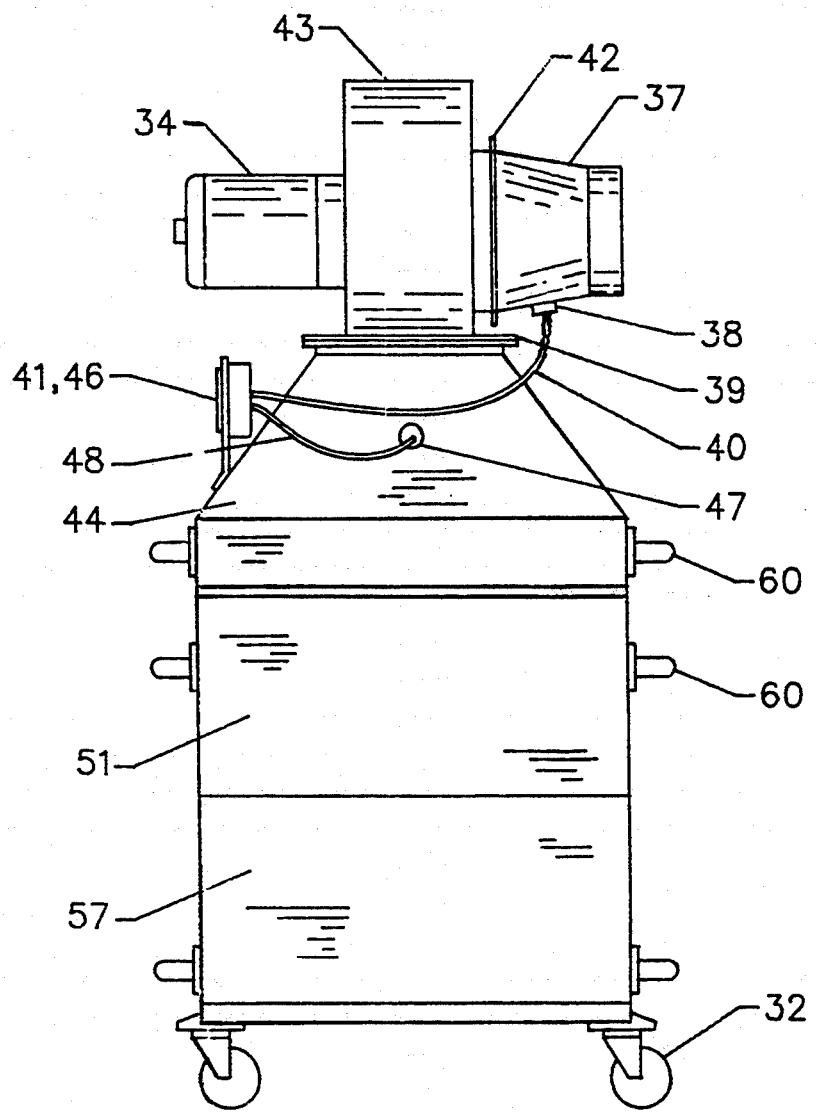
FIG. 5 is an elevation view of the right hand side of the modular fan-filtration assembly.
Figure 6:
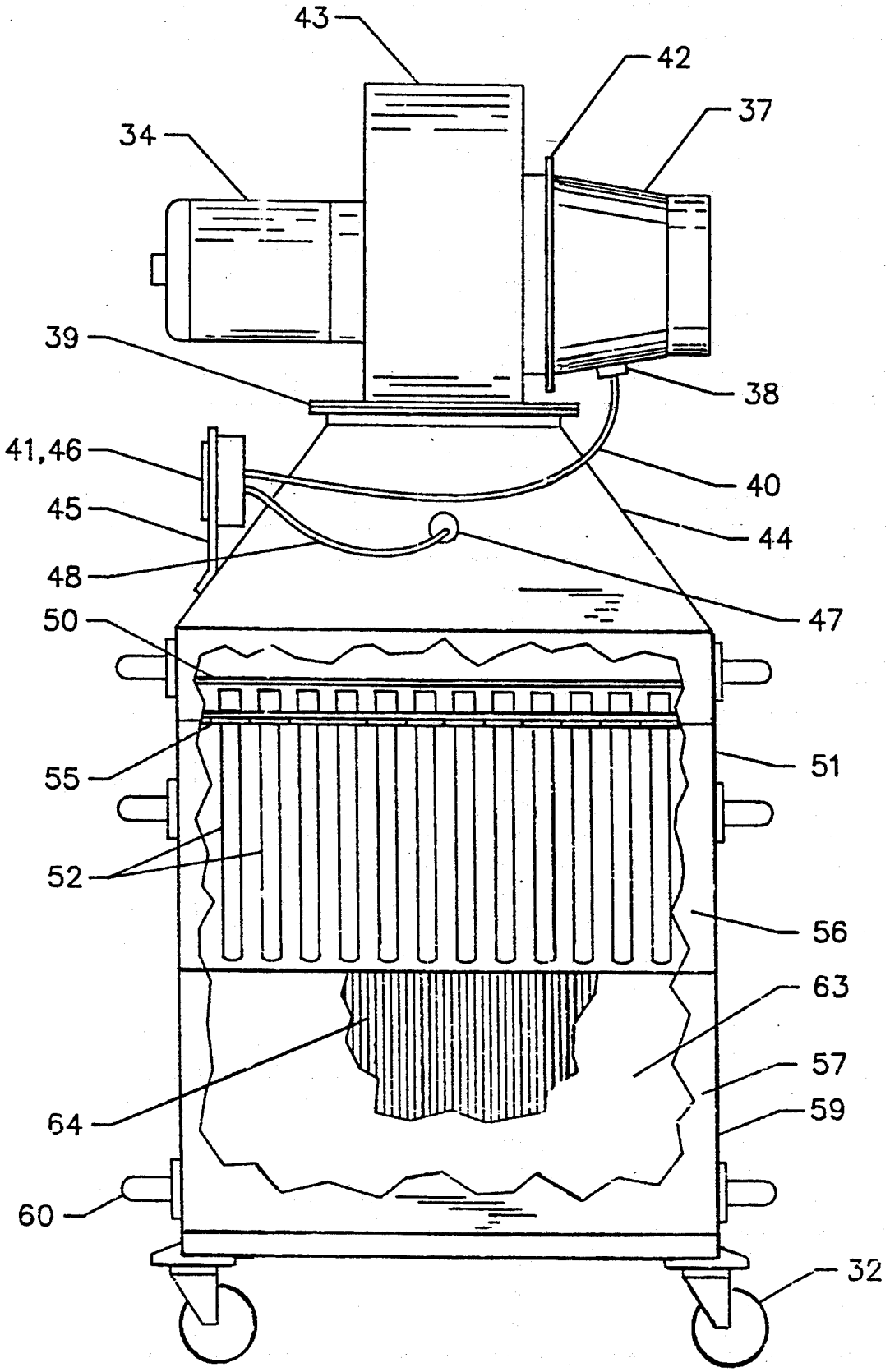
FIG. 6 is a cutaway elevation view from the right hand side of the modular fan-filtration assembly illustrating three levels of pressurized filtration of the air stream.
Figure 7:
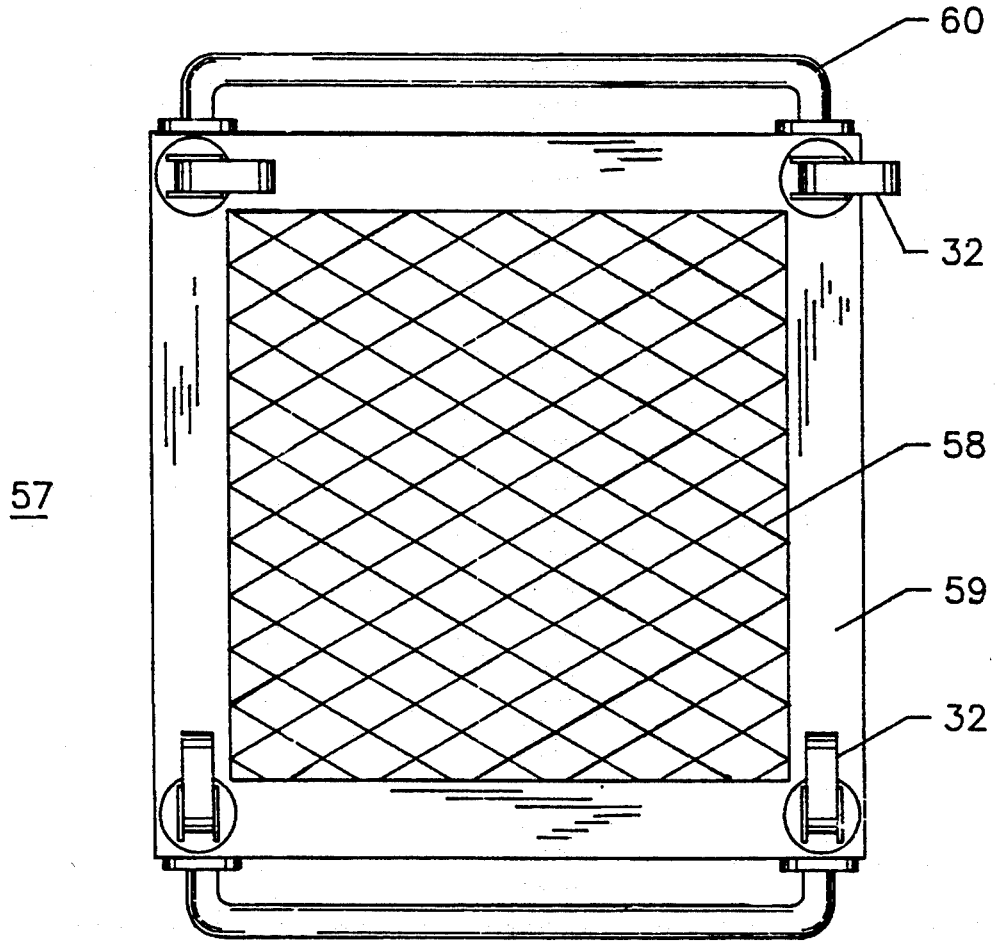
FIG. 7 is a plan view of the fan-filtration assembly looking upward into the base of the high efficiency particulate air (HEPA) filter module showing the expanded metal discharge port for filtered air stream.
Figure 8:
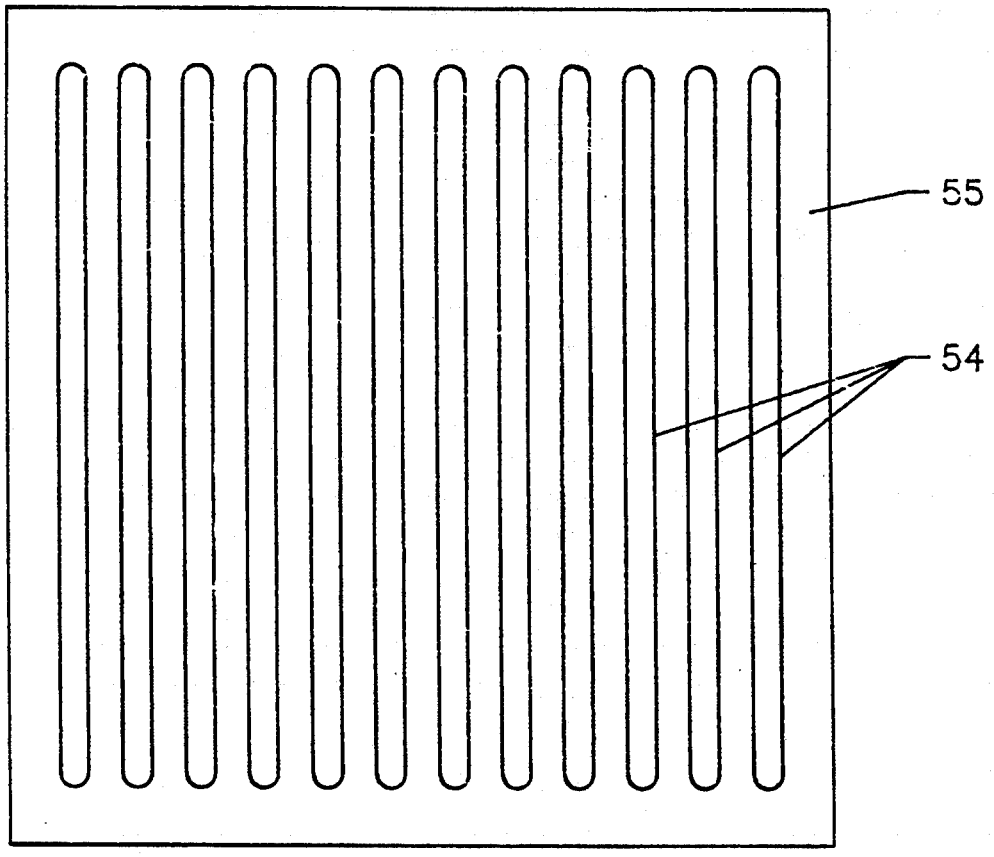
FIG. 8 is a plan view of the intermediate bag filter supporting plate.
Figure 9:
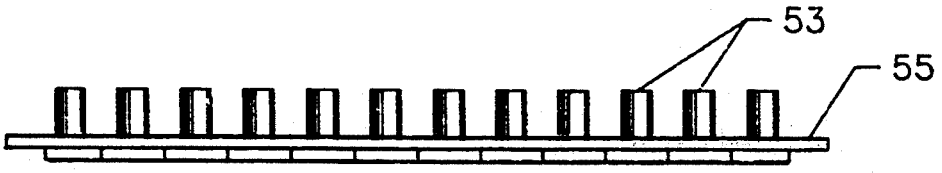
FIG. 9 is an edge view of the intermediate bag filter supporting plate with bag filter separating tubes assembled in the slots of the supporting plate.
Figure 10:
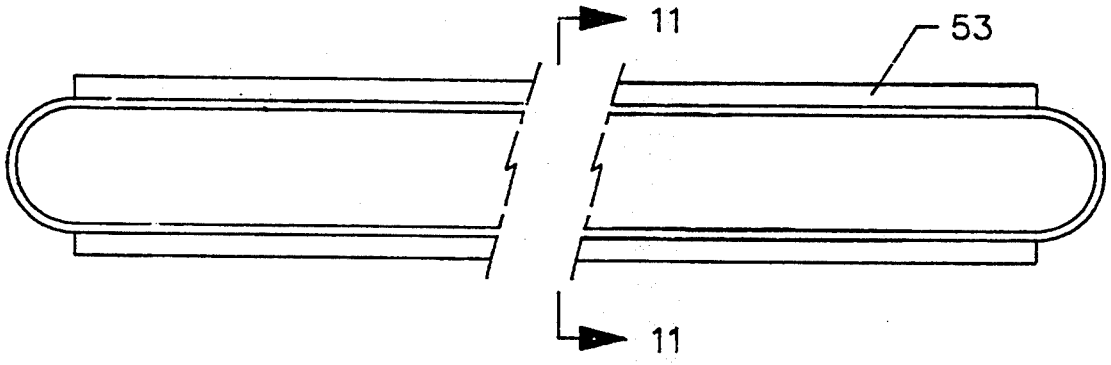
FIG. 10 is a plan view of the typical elongated bag filter separating tube.
Figure 11:
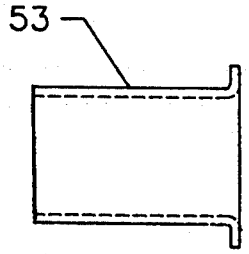
FIG. 11 is a cutaway elevation view of the filter separating tube as seen in the direction 11—11 of FIG. 10.
Figure 12:
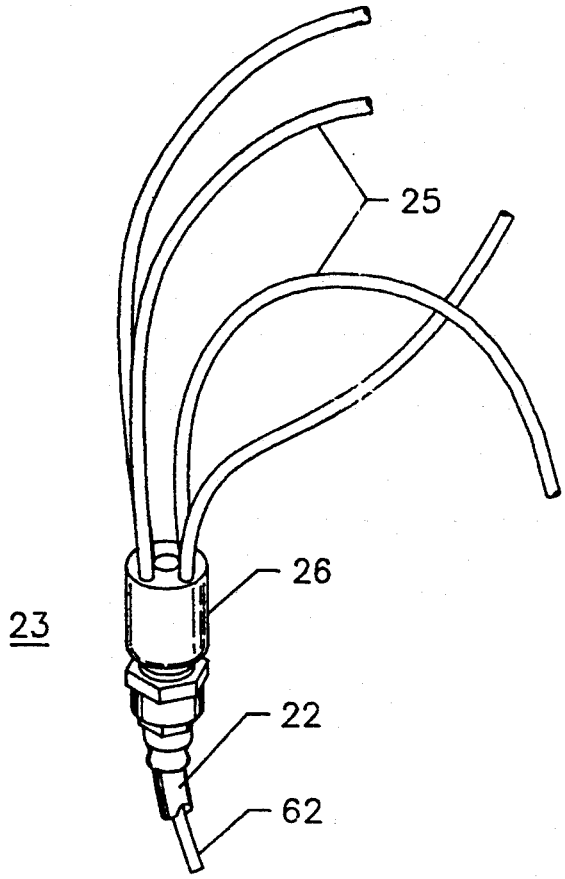
FIG. 12 illustrates the head assembly of the pneumatic multiple whip agitator which is used for dislodging extraneous matter from the interior walls of air ducts during cleaning.
Figure 15:
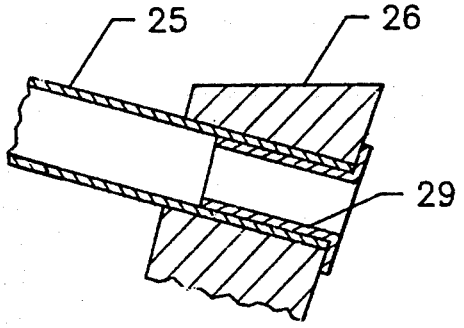
FIG. 15 is a cutaway illustration of the assembly of a typical pneumatic whip base to the pressure hose cap.
Figure 13:
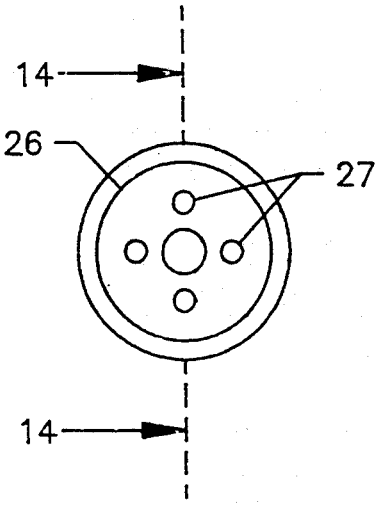
FIG. 13 is an end view of the pressure hose cap of the penumatic whip agitator.
Figure 14:
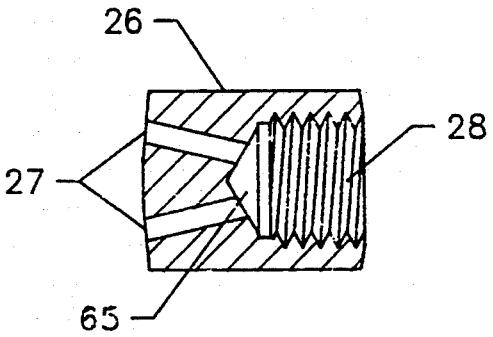
FIG. 14 is a cut-away view of the pressure hose cap taken along lines 14—14 of FIG. 13.

The fan subassembly 33 rests upon and is fixed to the second plenum module 44 which has a diverging rectangular form with openings at both top and bottom sides for air flow through the module 44. Shown in FIGS. 3–6 is the operator's instrument panel 45 in which the vacuum gauge 41 and a pressure gauge 46 are mounted. The pressure port 47 is connected by pressure tubing 48 to the air pressure gauge 46 which indicates air pressure within the plenum chamber 44. Seen in FIGS. 1–2 and 4 is the removable viewing window 49 which allows the operator to observe visually the passage of particulates, dust, and foreign matter into the chamber 44 during cleaning operations. The removable viewing window 49 is fastened to the plenum module 44 so that it can be readily removed, and it is sealed against air loss from the plenum. Through the viewing window 49 the operator may look down upon the replaceable sheet prefilter 50, FIG. 6, and observe the collection of large particles during the cleaning operation. In turn the plenum module 44 is seated upon the third module which is a bag filter box 51.

The top and bottom sides of the bag filter box 51 are open for passage of the air stream during cleaning operations. The bag filter box 51 contains multiple filtering bags 52 which are suspended from individual filtering tubes 53, FIGS. 9–11, which are assembled and fixed within the individual slots 54 arranged in parallel in the bag filter support plate 55, FIGS. 6, 8–9. The support plate 55 abuts all interior side walls of the shell 56 of the filter box module 51 so that the air stream, under pressure, cannot bypass the filter bags 52. The bag filter box module 51, in turn is sealed upon the fourth module which is the high efficiency particulate air filter (HEPA) 57.

The HEPA filter module 57 provides the final stage of filtering of the recovered particulate matter from the air stream. The top and bottom sides of the HEPA filter box are open for passage of the air stream during cleaning operations. The filter element 63 is a standard commercial type constructed of a dense continuous membrane that is folded back and forth over many parallel corrugated separators 64. It is sealed against air loss to the bottom side of the bag filter box 51. The air stream enters at the top side of the HEPA module 57 and passes out the bottom side through the expanded metal grille 58, FIG. 7, for discharge of the filtered air stream at floor level. The HEPA module 57 shell and frame 59 is raised and supported above the floor by the swiveling caster wheels 32.

The stacked plenum 44, bag filter box 51, and HEPA 57 modules can be dismounted for servicing and replacement of the enclosed sheet prefilter 50, the multiple bag filters 52, and the HEPA filter 57. The sheet prefilter 50 can be readily replaced through the removable viewing window 49 since this is the filter most often changed. Carrying handles 60 are provided for the plenum 44, the bag filter box 51 and the HEPA 57 module. When assembled and stacked vertically and secured by overthrow clasps 61, the respective shells 44, 56 and 59 provide sufficient sealing of the fan-filtration assembly 30 to prevent outward leakage of air which is under pressure for filtration during the duct cleaning operation. For cleaning of the duct system 10 the vacuum fan subassembly 33 provides suction for withdrawal of dislodged particulates and foreign matter and provides pressure to force the contaminated air stream through the multiple stages of filtration as provided by the sheet prefilter 50, the multiple bag filters 52 and the HEPA filter 63. Performance in the cleaning operation and the condition of the successive filters is continually displayed by the vacuum gauge 41 measurement of the level of suction in the hose cone adaptor 37 and by the pressure gauge 46 measurement of the level of pressure within the plenum chamber 44.

The efficiency in cleaning the air duct system 10 is improved by the pneumatic whip agitator 20 which is inserted and advanced within the air duct 10 to dislodge foreign matter from the interior walls. The agitator head assembly 23 is illustrated in FIGS. 12–15. Multiple open-ended flexible tubes 25, being unrestrained when continuously driven by compressed air that escapes against the ambient air within the duct 10 causing the unrestrained end of each flexible tube 25 to automatically move violently in random directions by generated thrust to beat or strike to impact against the interior surfaces of the air duct system 10, thereby by mechanical force the agitator cleaning head assembly 23 operates to dislodge the adhering and encrusted foreign materials and particulates from the surfaces, the corners, and crevices of the duct 10 and thereby pneumatic force of the escaping compressed air from the unrestrained ends of the flexible tubes 25 keeps the dislodging particles suspended in the air stream of the duct. The flexible tubing whips 25 which have quiescent curvatures are assembled in the pressure hose cap 26 typically as detailed in FIGS. 13–15. The pressure hose cap 26 has female threads 28 for assembly on the air compressor hose 22. Multiple cylindrical conduits 27 are provided in the hose cap 26 at acute angles relative to the air cavity 65 at the central axis of the cap 26, FIGS. 13–14. A flexible tube 25 is inserted, FIG. 15, into each of the conduits 27 of the pressure hose cap 26 and is secured in place by the cylindrical tubular fastener 29 which provides radial forces upon the flexible tube 25 against the pressure hose cap 26.

Duct systems 10 for air distribution in buildings may be cleaned with my invention by preliminary operation of the pneumatic whip agitator 20 followed by operation of the vacuum fan-filtration assembly 30, however, the preferred procedure for most efficient cleaning requires simultaneous operation of the agitator 20 and the vacuum fan-filtration 30 assemblies.

While a preferred embodiment has been described modifications and alternate embodiments are possible without departure from my invention which I claim as follows:

1. An apparatus for cleaning longitudinally elongated air channeling duct systems, comprising:

a. a pneumatic agitator subsystem for placement, by an attending person, through a first opening in said duct systems, comprising:

a continuing supply of compressed air for driving said pneumatic agitator subsystem;

a whipping agitator communicating with said supply of compressed air through a snaking fluid conduit for longitudinal movement within the interior cavity of a duct of said air channeling duct systems, said agitator comprising means responsive to said compressed air supply to cause said agitator to undergo whipping action resulting in continuing automatic violent impact striking responsive to automatic flow of said compressed air randomly directed between said agitator and interior surfaces of said duct to dislodge adhering matter from said interior duct surfaces and suspend particles of said matter in contaminated air within said interior duct cavity;

b. a vacuum cleaning subsystem for placement external to said duct systems for withdrawing said particles of dislodged matter in said contaminated air from said interior duct cavity through a sealed second opening into said duct systems, said vacuum subsystem comprising:

a continually operative vacuum fan;

a vacuum hose of appropriate diameter and length interposed between said vacuum fan and said second sealed opening into said interior duct cavity, said second opening is remotely removed from said first opening into said air channeling duct systems, said vacuum hose for conveying said particles in contaminated air from said duct systems to said cleaning subsystem; and c. a filtration subsystem communicating with said cleaning subsystem for recovery of said particles and air contaminants prior to discharge of filtered residual air into the local ambient environment of said air channeling duct systems.

2. An apparatus for cleaning longitudinally elongated air channeling duct systems as recited in claim 1, wherein said pneumatic agitator subsystem further comprises:

a. a compressor for providing said continuing supply of compressed air relative to the pressure of the ambient air within said duct system;

b. said whipping agitator comprising:

a cleaning head whip assembly of a multiplicity of flexible and resilient open-ended tubes in fluid communication with said compressor through said snaking fluid conduit that are each individually and independently responsive to thrust in producing random movement of said tube due to escape of said compressed air from the unrestrained end of each of said open-ended tubes;

c. a flexible compressed air hose interposed between said compressor and said cleaning head whip assembly for conveying said continuing supply of compressed air therebetween, said air hose comprising a means for use by said attending persons for advancing and for withdrawing said cleaning head whip assembly from said cavity of said duct systems; and d. a means for driving said compressor.

3. An apparatus for cleaning longitudinally elongated air channeling duct systems, as recited in claim 2, wherein said cleaning head whip assembly further comprises:

a. a threaded cap for connection to said flexible compressed air hose, said cap further comprising:

a central cavity about the axis of said threaded cap for receiving said compressed air supplied through said flexible compressed air hose;

multiple cylindrical fluid conduits distributed about said cap axis, said multiple conduits diverging outward from said central cavity;

b. one of said flexible and resilient tubes for each of said cylindrical fluid conduits; and c. a cylindrical tubular fastener for insertion in a first end of each said tube for securing said tube to said cap for a continuous fluid coupling to said supply of compressed air.

4. An apparatus for cleaning longitudinally elongated air channeling duct systems, as recited in claim 3, wherein each said flexible and resilient tube comprises:

a. a curved elongated tubular body, in the quiescent state, for enhancement of said whipping action of said unrestrained second end of said flexible tube.

5. An apparatus for cleaning longitudinally elongated air channeling duct systems, as recited in claim 2, wherein said compressed air hose comprises:

a. an elongated flexible tubular body;

b. a connector for each end of said elongated tubular body; and c. an elongated resilient steel tape for insertion inside said flexible tubular body, said steel tape having a width substantially equal to the inner diameter of said flexible tubular body and a length equal to the length of said flexible tubular body for strengthening said compressed air hose for enhancement of an operator's ability to move said whip agitator along said interior walls of said air channeling duct systems.

6. An apparatus for cleaning longitudinally elongated air channeling duct systems, as recited in claim 1, further comprising:

a. a monitoring subsystem for indicating to said attending person of said apparatus the status and performance of said vacuum cleaning and said filtration subsystems.

7. An apparatus for cleaning longitudinally elongated air channeling duct systems, as recited in claim 1, wherein said filtration subsystem comprises:

a. an assembly of multiple filters, located downstream from the output of said vacuum cleaning subsystem, operable at pressures exceeding the ambient air pressure of the local environment of said air channeling duct systems;

b. means for access to each filter of said assembly of multiple filters for servicing and replacement of filters; and c. means for preventing escape of particulates and unfiltered pressurized air from said assembly of multiple filters into said local environment.

8. An apparatus for cleaning longitudinally elongated air channeling duct systems, comprising:

a. a pneumatic whip agitator for dislodging adhering matter from the interior walls and surfaces of said air channeling duct systems, comprising:

a compressor for providing a continuing supply of compressed air relative to the pressure of the ambient air within said duct systems;

a flexible hose connected at a first end thereof to said compressor for conveying said supply of compressed air;

a cleaning head whip assembly connected to said flexible hose at a second end thereof for receiving said compressed air and for insertion and longitudinal movement, by an attending person, within the interior cavity of said duct systems said whip assembly comprising means responsive to said compressed air supply to cause said whip assembly to undergo automatic whipping action producing random impact striking of said whip assembly upon said interior duct surfaces to dislodge particulates of said adhering matter;

b. a vacuum cleaning subsystem for withdrawing said particulates and contaminated air from said interior cavities of said air channeling duct systems; and c. a filtration subsystem for recovery of air contaminants and said particulates and for discharge of filtered residual air into the local exterior ambient environment of said air channeling duct systems.

9. An apparatus for cleaning longitudinally elongated air channeling duct systems, as recited in claim 8, wherein said cleaning head whip assembly comprises:

a. a threaded cap for connection to said second end of said flexible hose, said cap comprising:

a central cavity about the axis of said threaded cap for receiving said compressed air supplied through said flexible hose;

multiple cylindrical fluid conduits uniformly distributed about said cap axis, said conduits diverging outward from said central cavity;

b. a flexible and resilient tube for each of said cylindrical fluid conduits, a first end of said flexible tube for insertion in said cylindrical conduit for receiving said compressed air, a second end of said flexible tube unrestrained for random whipping response to the escape therefrom of said compressed air; and c. a cylindrical tubular fastener for insertion in said first end of each said tube for securing said tube to said cap for continuous fluid coupling to said supply of compressed air.

10. An apparatus for cleaning longitudinally elongated air channeling duct systems, as recited in claim 9, wherein each said flexible and resilient tube comprises:

a. a curved elongated tubular body, in the quiescent state, for enhancement of said whipping response of said unrestrained second end of said flexible tube to said escape therefrom of said compressed air.

11. An apparatus for cleaning longitudinally elongated air channeling duct systems, as recited in claim 8, wherein said compressed air hose comprises:

a. an elongated flexible tubular body;

b. a first connector for the first end of said elongated tubular body;

c. a second connector for the second end to said elongated tubular body; and d. an elongated resilient steel tape for insertion inside said flexible tubular body, said steel tape having a width substantially equal to the inner diameter of said flexible tubular body and a length equal to the length of said flexible tubular body for strengthening said compressed air hose for enhancement of said person's ability to move said whip agitator along said interior walls of said air channeling duct systems.

12. An apparatus for cleaning longitudinally elongated air channeling duct systems, as recited in claim 8, wherein said vacuum cleaning subsystem comprises:

a. a fan for delivering a pressurized air stream with said contaminants and particulates drawn from said duct systems to said filtration subsystem relative to air pressures of the local ambient environment where said apparatus is operated.

13. A apparatus for cleaning longitudinally elongated air channeling duct systems, as recited in claim 8, further comprising:

a. a monitoring subsystem for indicating to said attending person of said apparatus the status and performance of said vacuum cleaning and said filtration subsystems, comprising;

a vacuum gauge for the measurement and display of negative air pressures at an intake adaptor of said vacuum cleaning subsystem, relative to pressures of said local ambient environment; and a pressure gauge for the measurement and display of positive air pressures in the contaminated air stream delivered by said vacuum cleaning subsystem to said filtration subsystem, relative to said pressures of said local ambient environment.

14. An apparatus for cleaning longitudinally elongated air channeling duct systems, as recited in claim 13, wherein said monitoring subsystem further comprises:

a. a transparent window for visual observation by said attending person of said contaminated air stream at a junction between said vacuum cleaning and said filtration subsystems.

15. An apparatus for cleaning longitudinally elongated air channeling duct systems, as recited in claim 8, wherein said filtration subsystem comprises:

a. a removable prefilter of coarse particulates;

b. a multiplicity of removable intermediate bag filters arranged in parallel for receiving the filtered output of said prefilter; and c. a removable high efficiency particulate air filter for receiving the filtered output of said multiplicity of intermediate bag filters for filtering fine particulates prior to discharge of filtered air into said local ambient environment.

16. Cleaning apparatus for air channeling duct systems, comprising:

a. a first cleaning apparatus comprising multiple modules reversibly assembled for manual roll-about portability by attending persons, said first apparatus comprising:

a modular fan unit comprising:

a backward inclined air fan responsive to rotation, for withdrawing contaminated air and particulates at vacuum pressures from said duct systems and for delivering said contaminated air and particulates at a pressure exceeding the air pressure of the cleaning area environment;

a means for rotation of said backward inclined air fan;

at least one interchangeable cone adaptor for an input access to said air fan; and an output adaptor flange for said pressurized output delivery of contaminated air and particulates from said fan unit:

at least one selectable vacuum hose interposed between said fan input cone adaptor and a sealed duct opening, made by said attending persons into said duct systems, for conveying said contaminated air and particulates therebetween;

a pressurized plenum module comprising:

means for detachable assembly to said fan unit output adaptor flange for receiving said pressurized contaminated air and particulates and for structural support of said fan module;

an open internal chamber for collection of coarse particulates;

a replaceable prefilter for separating said coarse particulates from said pressurized contaminated air and particulates; and means for passage of prefiltered contaminated air and residual particulates from said plenum module;

a pressurized filter box module comprising:

means for detachable assembly to said plenum module for support of said combined fan unit and plenum modules and for receiving said prefiltered contaminated air and particulates;

multiplicity of replaceable bag filters for separating particulates of intermediate sizes from said prefiltered contaminated air and particulates;

means for forcing said prefiltered contaminated air and particulates into said bag filters and for suspending said bag filters in parallel assemblies; and means for passage of the second stage of filtered contaminated air and residual particulates from said filter box module;

a pressurized high efficiency particulate air filter (HEPA) module comprising:

means for detachable assembly to said filter box module for said support of said combined fan unit, said plenum and bag filter box modules and for receiving said second stage of filtered contaminated air and residual particulates;

a replaceable folded membrane HEPA filter for separating particulates and contaminants of minute sizes from said second stage of filtered contaminated air and residual particulates;

an expanded metal discharge opening for the passage of final filtered air into said cleaning area environment; and means for said roll-about portability of said first cleaning apparatus upon flat surfaces;

a monitoring subsystem for use by said attending persons, of the operating status and performance of said fan unit, said prefilter, and said bag and HEPA filters, comprising:

a removable viewing window through the enclosure of said plenum module for observation of the flow of said contaminated air and particulates and for observation of collected coarse particulates by said prefilter;

a vacuum gauge for measurement of air pressures within said cone adaptor and said vacuum hose; and a pressure gauge for measurement of air pressures within said plenum module relative to the pressure of said ambient of the cleaning environment;

b. a second cleaning apparatus, for use by said persons to enhance the efficiency of cleaning said duct systems, comprising:

a compressor for a continuing supply of compressed air relative to said ambient pressure of said cleaning environment;

a pneumatic cleaning head whip assembly, for insertion through an unrestrained duct opening that is removed from said sealed duct opening admitting said vacuum hose and for longitudinal movement within a length of the interior cavity of said duct system by action of said attending persons, said whip assembly comprising:

a hose cap comprising a cavity about the central axis of said cap; and multiple cylindrical conduits extending outward from said cap cavity;

a multiplicity of flexible tubes, one said tube for insertion in each of said hose cap cylindrical conduits, the loose open end of each said flexible tube responsive to the passage and escape of said compressed air therefrom in effecting randomly directed impact striking of said tube upon interior surfaces of said duct systems;

a compressed air hose interposed between said compressor and said cleaning head assembly, said air hose comprising:

an elongated hose for conveying said compressed air;

a resilient spring steel tape inserted inside the full length of said elongated hose for sufficient stiffness of said compressed air hose to enable said longitudinal movement of said pneumatic cleaning head assembly within said interior cavity of said duct systems; and means for connecting said compressed air hose to said compressor and to said pneumatic cleaning head assembly.

* * * * *